US010364821B2

(12) United States Patent
Pohler

(10) Patent No.: US 10,364,821 B2
(45) Date of Patent: Jul. 30, 2019

(54) GRINDER PUMP AND CUTTING ASSEMBLY THEREOF

(71) Applicant: Liberty Pumps, Inc., Bergen, NY (US)

(72) Inventor: Donald M. Pohler, North Chili, NY (US)

(73) Assignee: Liberty Pumps, Inc., Bergen, NY (US)

( * ) Notice: Subject to any disclaimer, the term of this patent is extended or adjusted under 35 U.S.C. 154(b) by 228 days.

(21) Appl. No.: 15/407,189

(22) Filed: Jan. 16, 2017

(65) Prior Publication Data

US 2018/0202453 A1 Jul. 19, 2018

(51) Int. Cl.

| | |
|---|---|
| ***F04D 7/04*** | (2006.01) |
| ***B02C 18/00*** | (2006.01) |
| ***F04D 13/08*** | (2006.01) |
| ***F04D 29/22*** | (2006.01) |

(52) U.S. Cl.

CPC ..... *F04D 29/2288* (2013.01); *B02C 18/0092* (2013.01); *F04D 7/045* (2013.01); *F04D 13/086* (2013.01); *B02C 2201/063* (2013.01)

(58) Field of Classification Search

CPC .... F04D 29/2288; F04D 7/045; F04D 13/086; B02C 18/0092

USPC ..... 415/121.1

See application file for complete search history.

(56) References Cited

U.S. PATENT DOCUMENTS

| | | | | |
|---|---|---|---|---|
| 3,650,481 | A | 3/1972 | Conery et al. | |
| 3,961,758 | A | 6/1976 | Morgan | |
| 4,108,386 | A | 8/1978 | Conery et al. | |
| 4,378,093 | A | 3/1983 | Keener | |
| 4,454,993 | A | 6/1984 | Shibata et al. | |
| 4,640,666 | A | 2/1987 | Sodergard | |
| 4,697,746 | A | 10/1987 | Nishimori | |
| 4,842,479 | A | 6/1989 | Dorsch | |
| 5,016,825 | A | 5/1991 | Carpenter | |
| 5,044,566 | A | 9/1991 | Mitsch | |
| 5,256,032 | A | 10/1993 | Dorsch | |
| 6,010,086 | A | 1/2000 | Earle et al. | |
| 6,190,121 | B1 | 2/2001 | Hayward et al. | |
| 7,159,806 | B1 | 1/2007 | Ritsema | |
| 7,996,931 | B2 * | 8/2011 | Plette | E04H 4/1236 241/46.01 |
| 8,105,017 | B2 * | 1/2012 | Dorsch | F04D 29/2288 415/121.1 |
| 8,267,643 | B2 * | 9/2012 | Wagner | F04D 7/045 415/121.1 |
| 8,562,287 | B2 * | 10/2013 | Schmidt | E03F 5/22 415/121.1 |

(Continued)

*Primary Examiner* — Justin D Seabe
*Assistant Examiner* — Hakeem M Abdellaoui
(74) *Attorney, Agent, or Firm* — John M. Hammond; Patent Innovations LLC

(57) ABSTRACT

A cutting assembly and a grinder pump including the cutting assembly are disclosed. The cutting assembly includes a cutting plate that has a plurality of cutting ports with cutting edges that are distributed over a range of radial locations of the plate. The cutting edges of the cutting ports define a series of cutting regions of the cutting blades of a rotary cutter that operate in a shearing action with the cutter plate. The cutting action by the blades of the rotary cutter is distributed over nearly the entire lengths of the cutting edges of the cutting blades, thereby distributing the wear on the cutting blades evenly, and extending cutting assembly life.

17 Claims, 8 Drawing Sheets

(56) References Cited

U.S. PATENT DOCUMENTS

| | | | | |
|---|---|---|---|---|
| 8,657,564 | B2 * | 2/2014 | Cuppetelli | F04D 29/2288 415/121.1 |
| 8,784,038 | B2 * | 7/2014 | Ciotola | B02C 18/0092 241/21 |
| 8,905,341 | B2 * | 12/2014 | Dorsch | F04D 7/045 241/46.017 |
| 9,475,059 | B2 * | 10/2016 | Vallen | B02C 18/062 |
| 9,719,515 | B2 | 8/2017 | Pohler | |
| 9,719,527 | B2 * | 8/2017 | Mitsch | F04D 7/045 |
| 10,054,136 | B2 * | 8/2018 | Sowa | F04D 1/003 |
| 2014/0199165 | A1 * | 7/2014 | Pohler | F04D 7/045 415/204 |

* cited by examiner

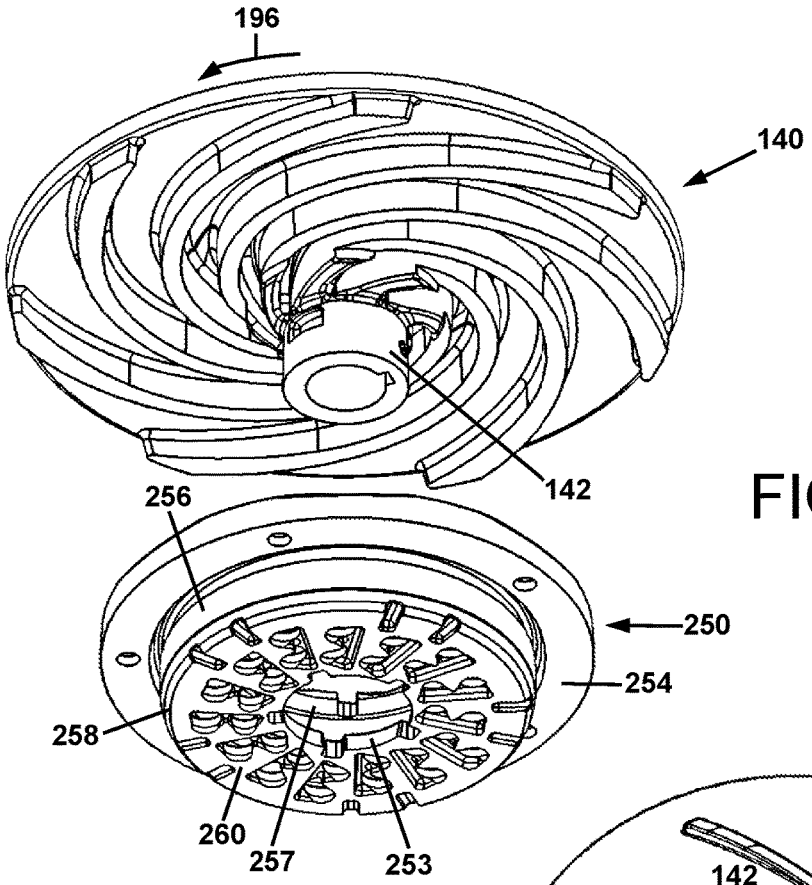
FIG. 8
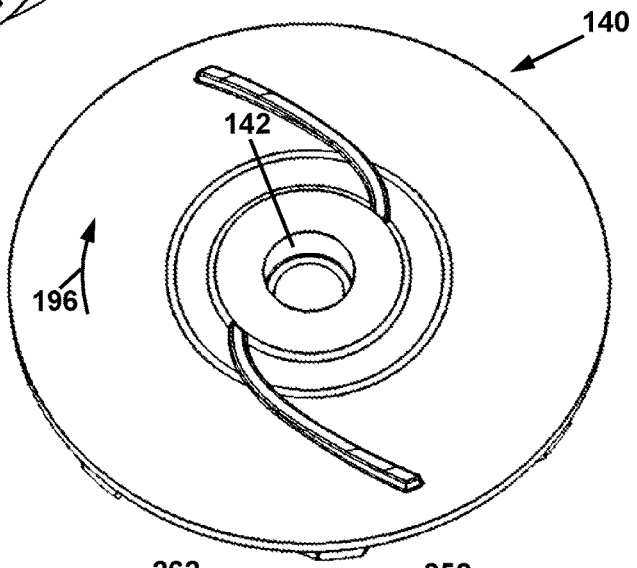
FIG. 9
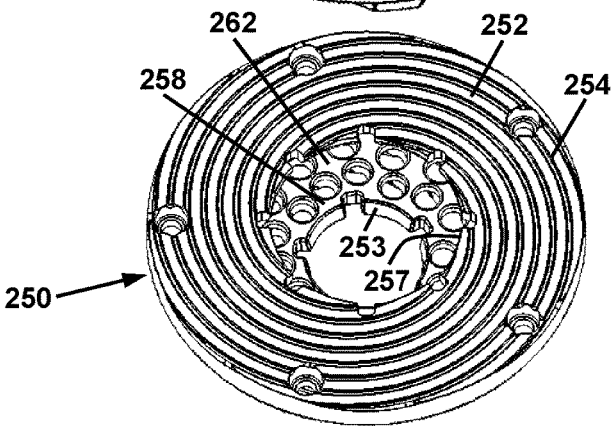

GRINDER PUMP AND CUTTING ASSEMBLY THEREOF

BACKGROUND

Technical Field

Grinding impeller and cutting assemblies for grinder pumps, for reducing the size of suspended solids in a liquid stream and simultaneously pumping the liquid stream.

Description of Related Art

Grinder pumps are commonly used in liquid transfer applications that require the grinding of large solid or semisolid materials contained in a liquid, in order to grind, cut, or shred such materials. Ultimately, such solid or semisolid materials are reduced in size to the point where a slurry is formed, which is more easily pumped or otherwise transported, and which is more disposable than the solids themselves. Grinder pumps typically have an axial inlet connected to a pumping chamber, and a driven shaft extending through the pumping chamber and into the inlet. The shaft rotates a cutting cylinder in proximity to an annular ring, or a cutting disk in proximity to a cutter plate, thereby providing the cutting action of the pump. Numerous other variations and configurations of grinder pumps are known, which are intended to provide shearing action between shearing parts operating cooperatively at close tolerances.

The configuration of the cutting disk and annular ring, or of the other shearing parts are of high importance in the operation of grinder pumps. The particular shearing parts must be capable of shearing a wide range of entrained solids in a liquid stream that is entering the pump. In commercial and residential sewage pumping applications, such solids include fecal matter, feminine hygiene products, cigarette butts, waste foodstuffs, food wrappers and other food containers, as well as a range of unintentionally entrained solids such as small articles of clothing and small toys. Such solids have a wide variety of properties that are adverse to the operation of the pump, including high shear strength, abrasiveness, hardness, elasticity, and/or plasticity. Materials that are abrasive may gradually wear away the cutting edges of the grinding parts of the pump. Materials that have high shear strength and/or high hardness may shatter or deform the cutting edges of the grinding parts of the pump. In general, the shearing action that occurs in conventional grinder pumps occurs at a limited number of fixed locations on a cutter plate of a grinder pump, and even fewer corresponding radial locations on a cutter blade of a grinder pump. This high degree of localization of shearing action results in a relatively high rate of wear of the cutter plate and/or cutter blade at the shearing locations, thus reducing the life of the grinder pump: at some point, when the wear or impact damage to the shearing regions of the cutting assembly become excessive, and the pump is no longer able to grind the solid materials commonly present in the particular application, it must be replaced.

Additionally, materials that undergo elastic and/or plastic deformation may be particularly resistant to the cutting action by the grinding parts of the pump. Thus another problem in grinder pump operation occurs, because instead of being cleanly cut up into smaller parts, these materials may deform and "gum up" or associate into fibrous string-like materials, and clog the grinder pump. Fibrous, string-like materials, whether formed by association of ground solids during the grinding process, or present as fibrous incoming solids, are particularly difficult to shred with a grinder pump. In particular, the relatively long length and elastic or plastic properties often cause them to wrap around the internal pump components parts such as a cutting disk, a pump shaft, and/or the central region of a pump impeller proximate to the shaft. Once the shaft and central region of a pump impeller are shrouded with wrapped fibrous material, it is difficult to dislodge such materials. There is no effective way to scrape the shrouded regions clean, and the liquid flow patterns within the pump volute act to retain the fibrous material in place. Additionally, because this internal region of a grinder pump is hidden from view (and it is undesirable to perform any routine inspection of the pump, given the contents of the fluid stream), such a clogging problem goes undetected for a prolonged period of time. In sewage grinding applications, typically little or no instrumentation (such as pressure and-/or flow) is provided, and the users (e.g., homeowners) are not knowledgeable about pumps. Thus a grinder pump may be operated until a clogging problem progresses to the point of the pump being unable to perform its intended task before it is noticed. At that point, the situation is urgent, and the tasks required to solve the problem are much more unpleasant.

What is needed is a cutting assembly for a grinder pump that is less susceptible to wear in the cutting regions of the assembly, and thus has a longer service life. There is also a need for a grinder pump with a cutting assembly that is not prone to accumulating suspended solids in localized regions of the pump impeller and/or cutting assembly, such that performance of the grinder pump is maintained without any remedial or maintenance action required.

SUMMARY

In accordance with the present disclosure, the problem of a high rate of wear and associated reduced life of a cutting assembly in a grinder pump is solved by a cutting plate that has a plurality of cutting edges in the plate that are distributed over a range of radial locations, such that the cutting edges of the cutting ports define a series of cutting regions of the cutting blades of a rotary cutter that operate in a shearing action with the cutter plate.

In certain embodiments, the cutting assembly is comprised of a drive shaft, a rotary cutter, and a cutter plate. The drive shaft is rotatable in a first direction around an axis of rotation. The rotary cutter is rotatably engaged with the drive shaft and comprised of at least a first cutting blade and a second cutting blade. Each of the first and the second cutting blades include a leading blade cutting edge advanceable in the direction of rotation. The cutter plate is comprised of a cutter wall including an inner discharge surface, an outer cutter surface perpendicular to the axis of rotation of the drive shaft, a central opening defined by a side wall surrounding an outer end portion of the drive shaft, and a plurality of cutting ports. Each of the cutting ports comprises a plate cutting edge and a first orifice extending from the outer cutter surface to the inner discharge surface. The plurality of cutting ports is distributed around the central opening over a range of radial distances from the side wall of the central opening.

In operation of the cutting assembly, when the rotary cutter is rotated in the first direction of rotation, the cutting blades are rotationally advanced along the outer cutter surface of the cutter wall in a shearing action against the plate cutting edge of the radially innermost cutting port at a radially innermost cutting region of the cutting blades, against the plate cutting edges of radially intermediate cutting ports at a radially intermediate cutting region of the cutting blades, and against the plate cutting edge of the outermost cutting port at a radially outermost cutting region of the cutting blades. In that manner, the cutting action by the blades of the rotary cutter is distributed over nearly the entire lengths of the cutting edges of the cutting blades, thereby distributing the wear on the cutting blades evenly, and extending cutting assembly life.

In certain embodiments, the plurality of cutting ports may be provided in repeating groups of cutting ports that are distributed around the central opening of the cutter wall. The groups of cutting ports may be distributed around the central opening of the cutter wall at equal circumferential intervals. Within each group of cutting ports, the ports may be distributed at equal radial intervals from an innermost radial location to an outermost radial location of the cutter wall. In certain preferred embodiments, each of the groups of cutting ports may include from three to six cutting ports.

The cutting ports may be distributed over a range of radial locations from an innermost radial location to an outermost radial location of the cutter wall. Each of the cutting ports may be located at a unique polar coordinate on the outer cutter surface with respect to the axis of rotation of the drive shaft. In such embodiments, for each of the cutting blades of the rotary cutter, the plate cutting edges of the cutting ports define a series of cutting regions of the cutting blade that form a total cutting region of the cutting blade. Such an arrangement is effective in further distributing the wear on the cutting blades evenly.

In certain embodiments, each of the cutting ports may be comprised of a plurality of orifices. Such multi-orifice cutting ports may be provided in repeating groups of cutting ports distributed around the central opening of the cutter wall. In one embodiment, the repeating groups of multi-orifice cutting ports may each include three cutting ports.

Also according to the present disclosure, a grinder pump is provided, comprising a housing including a volute housing portion forming a pump volute enclosing a pump impeller, and a cutting assembly as described above. In certain embodiments, the cutter plate of the cutting assembly is further comprised of an inner wall comprising a volute surface that forms a portion of the pump volute. The cutter plate may be further comprised of a side wall, in which case the cutter wall, side wall, and inner wall form an annular cavity. The annular cavity is in fluid communication with an exterior of the cutter wall, and in fluid communication with the pump volute. In the operation of the grinder pump, solid objects are ground up by the cutter assembly and are entrained in the liquid passing through the cutting ports into the annular cavity, onward into the pump volute, and out the discharge port of the pump by the action of the pump impeller.

BRIEF DESCRIPTION OF THE DRAWINGS

The present disclosure will be provided with reference to the following drawings, in which like numerals refer to like elements, and in which:

FIG. 8 is a lower exploded perspective view of the impeller and cutter plate of the cutting assembly; and FIG. 9 is an upper exploded perspective view of the impeller and cutter plate of the cutting assembly.

Figure 1:
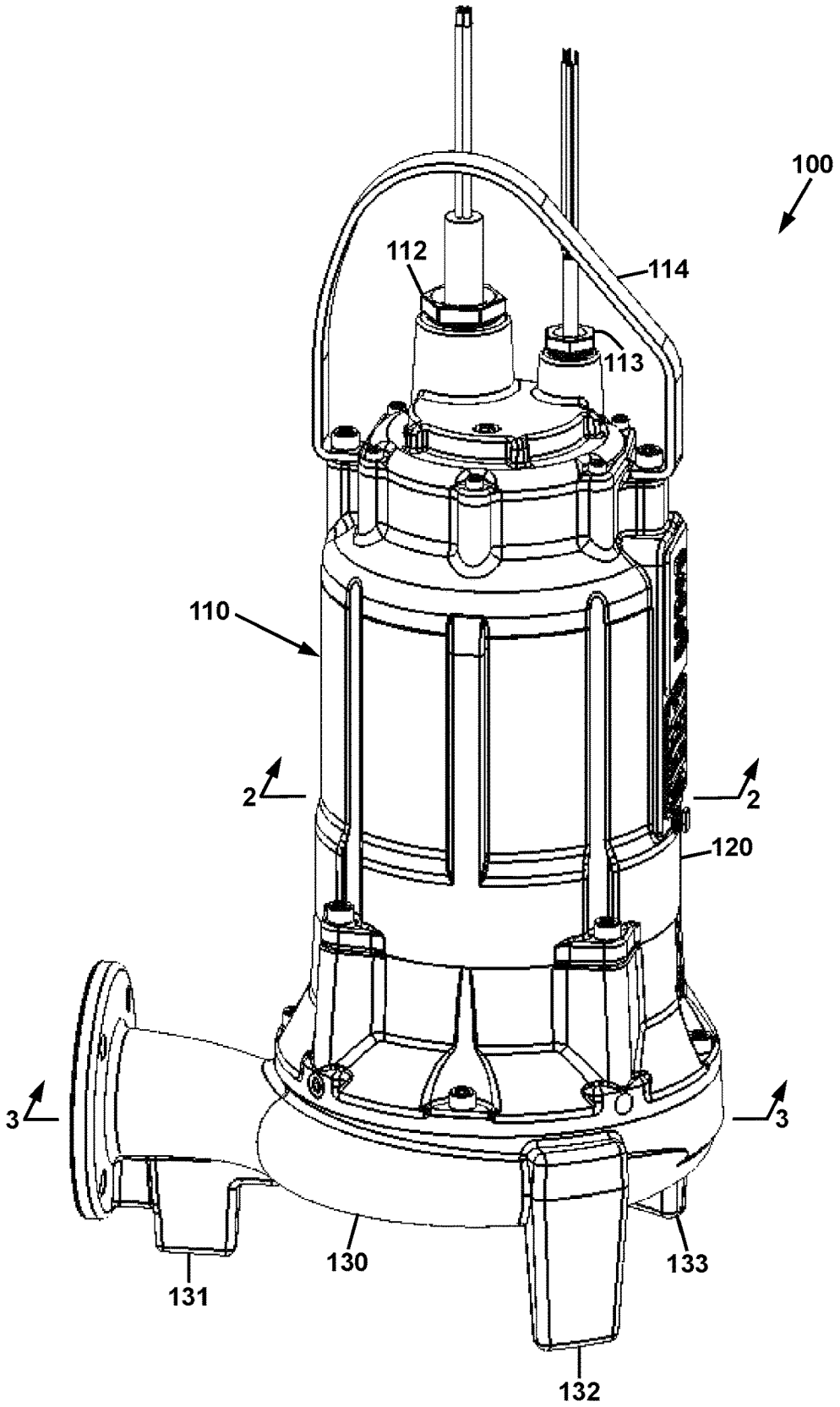
FIG. 1 is a upper perspective view of a grinder pump that includes the cutting assembly and solids-shedding impeller of the present disclosure.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, a cutting assembly is described in the context of its use in a grinder pump. However, it is not to be construed as being limited only to use in grinder pumps. The cutting assembly of the present disclosure is adaptable to any use in which reducing the size of suspended solids in a liquid stream is desirable to be provided. Additionally, this disclosure may identity certain components with the adjectives "top," "upper," "bottom," "lower," "left," "right," etc. These adjectives are provided in the context of use of the cutting assembly in a grinder pump, and in the context of the orientation of the drawings, which is arbitrary. The description is not to be construed as limiting the cutting assembly and/or the pump to use in a particular spatial orientation. The instant cutting assembly and pump may be used in orientations other than those shown and described herein.

It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

Figure 2:
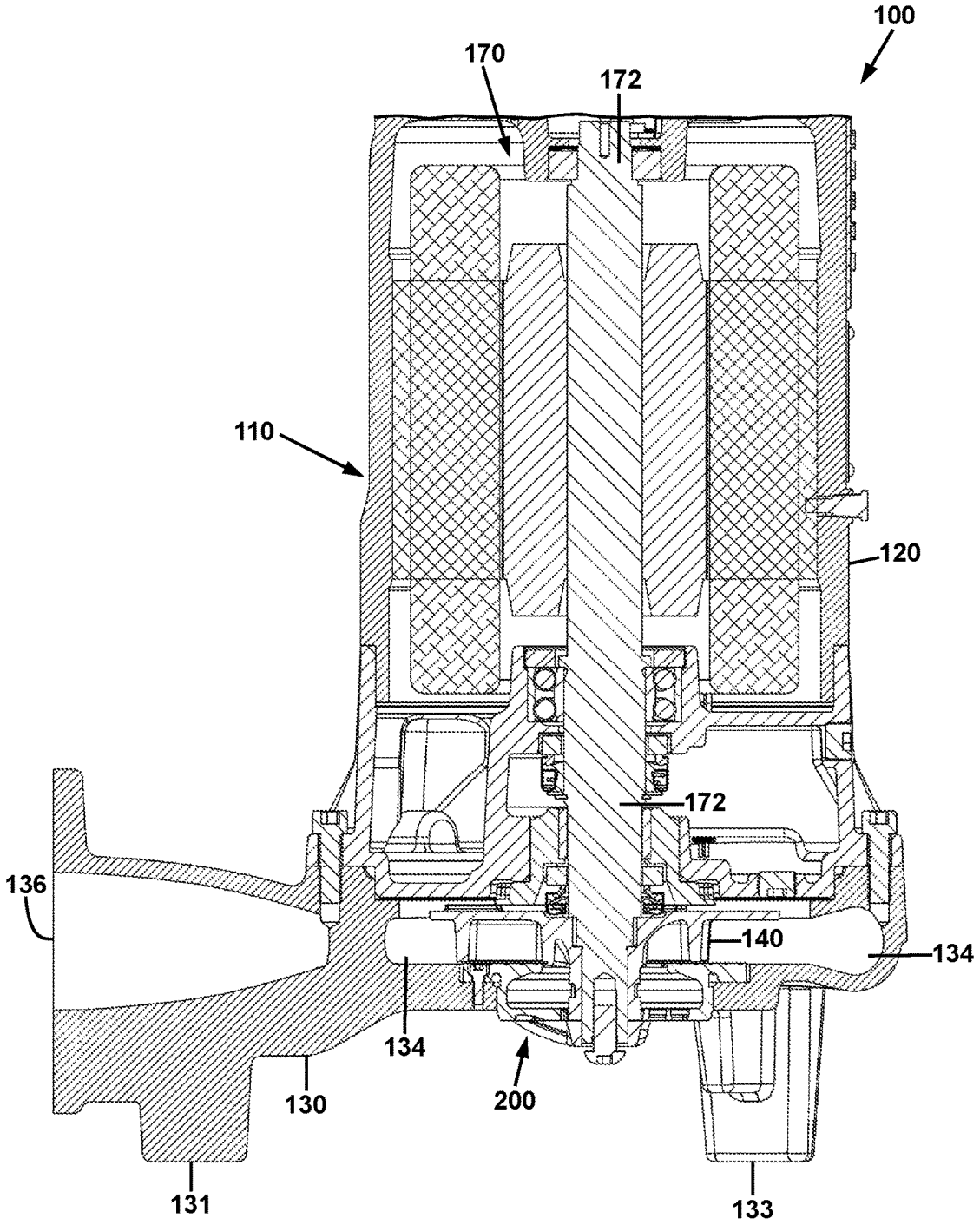
FIG. 2 is a side cross-sectional view of the pump of FIG. 1 taken along line 2-2 of FIG. 1.

The general construction of grinder pumps that utilize the cutting assembly of the present disclosure may vary to some degree. FIG. 1 is an upper perspective view of one embodiment of a grinder pump that utilizes the cutting assembly and solids-shedding impeller of the present disclosure; and FIG. 2 is a cross-sectional view of the grinder pump of FIG. 1, taken along line 2-2 thereof. Referring to FIGS. 1 and 2, pump 100 comprises a housing 110 including a motor portion 120 and a volute portion 130. Pump motor 170 is disposed within housing portion 120, and comprises motor drive shaft 172. Pump 100 may optionally comprise numerous other elements beneficial to the operation and control thereof, such as control switches (not shown), sealed cord fittings 112 and 113, handle 114, and support feet 131, 132, and 133.

Figure 3:
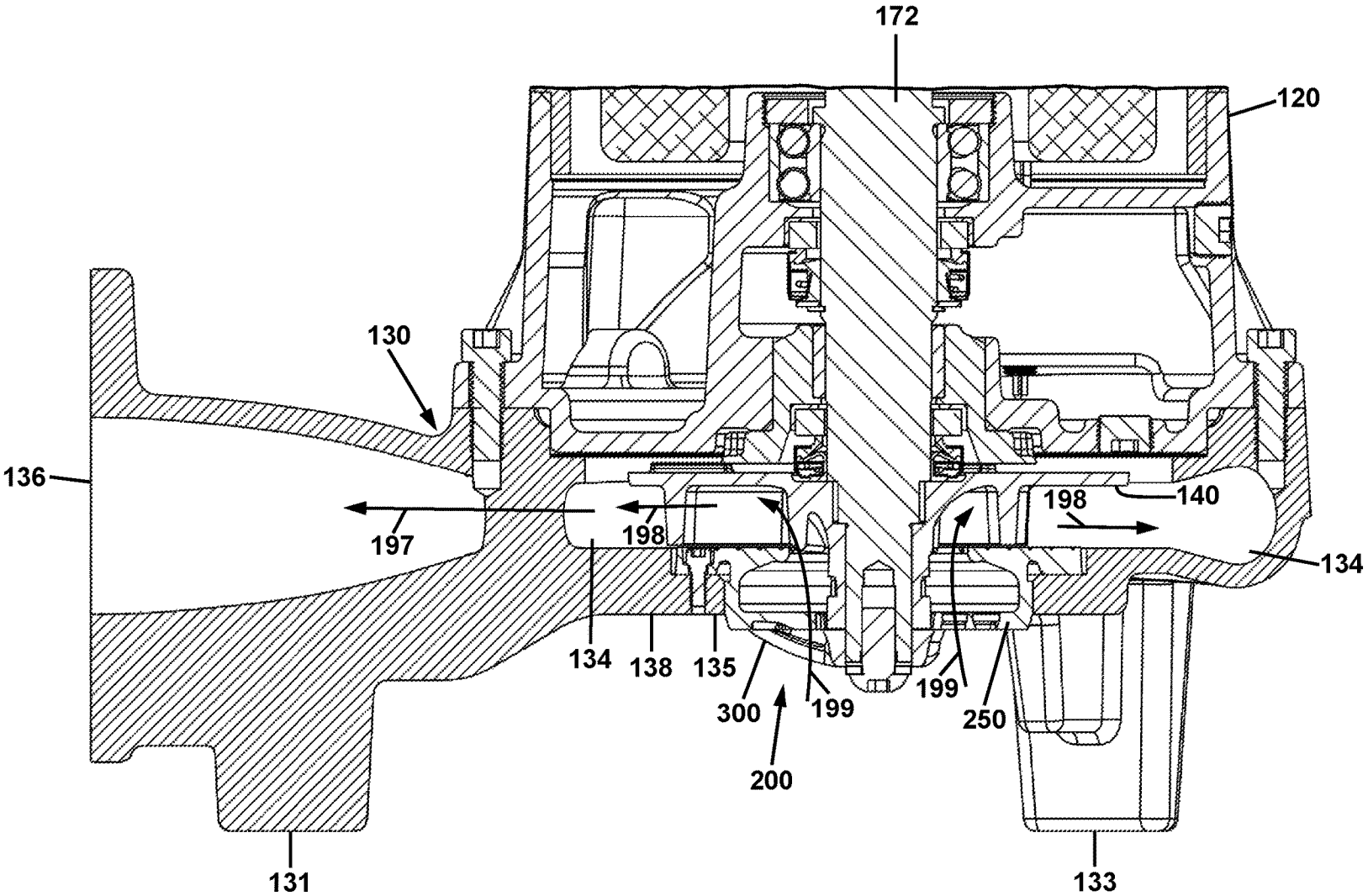
FIG. 3 is a detailed side cross-sectional view of the pump of FIG. 1 taken along and in the region of line 3-3 of FIG. 1.
Figure 4:
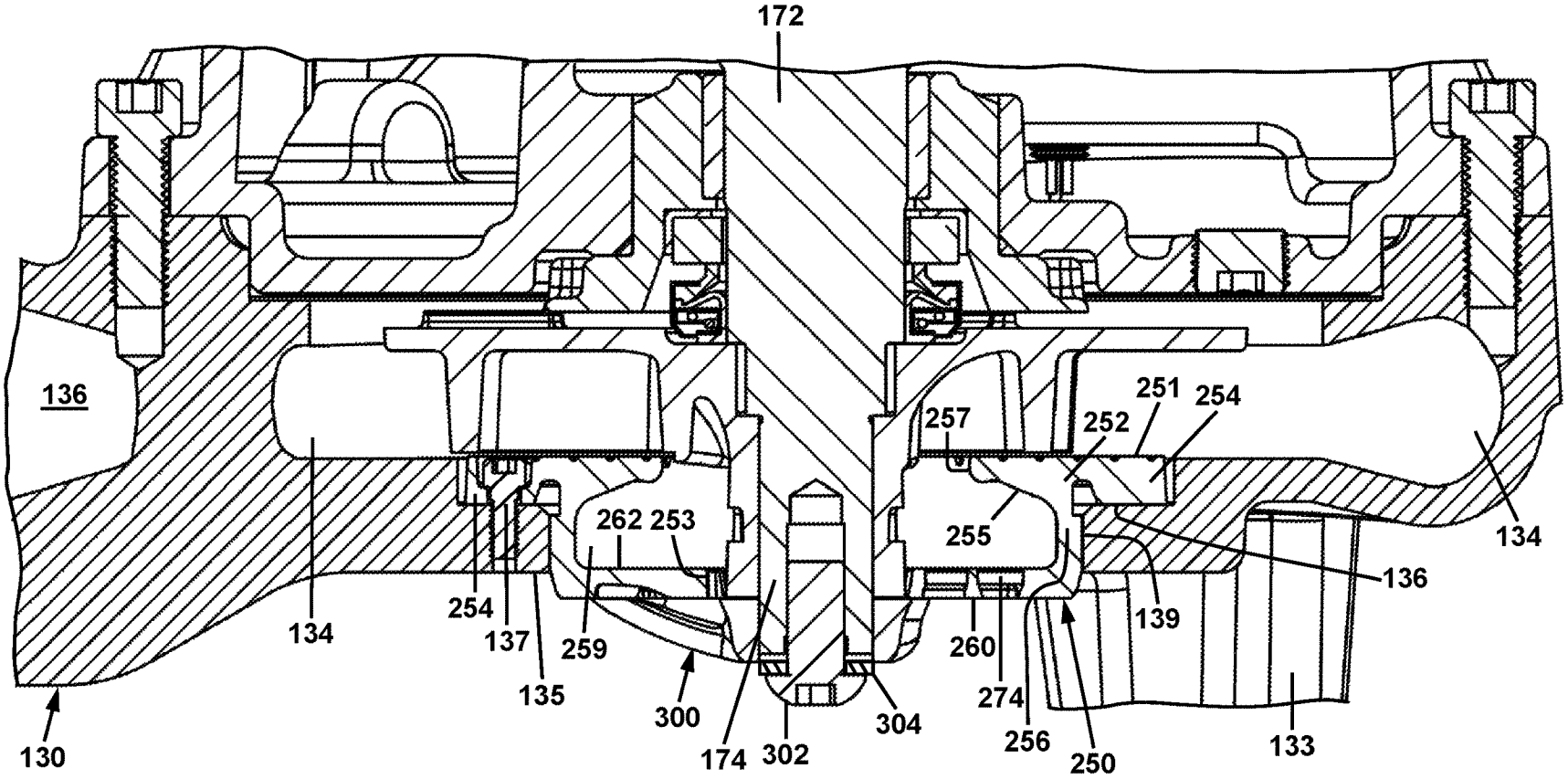
FIG. 4 is a highly detailed side cross-sectional view of the pump volute, impeller, and cutting assembly of the pump of FIG. 1, also taken along and in the region of line 3-3 of FIG. 1.
Figure 5B:
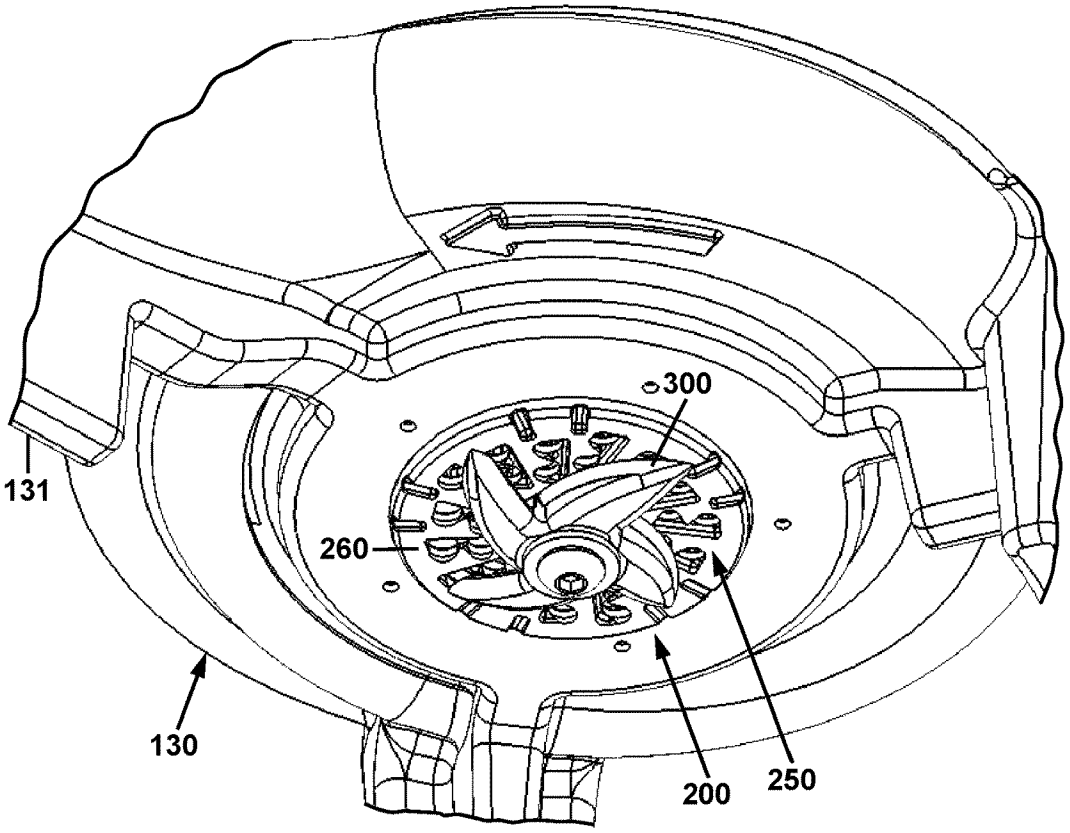
FIG. 5B is a detailed lower perspective view of the external portion of the cutting assembly of the pump as depicted in FIG. 5A.
Figure 5A:
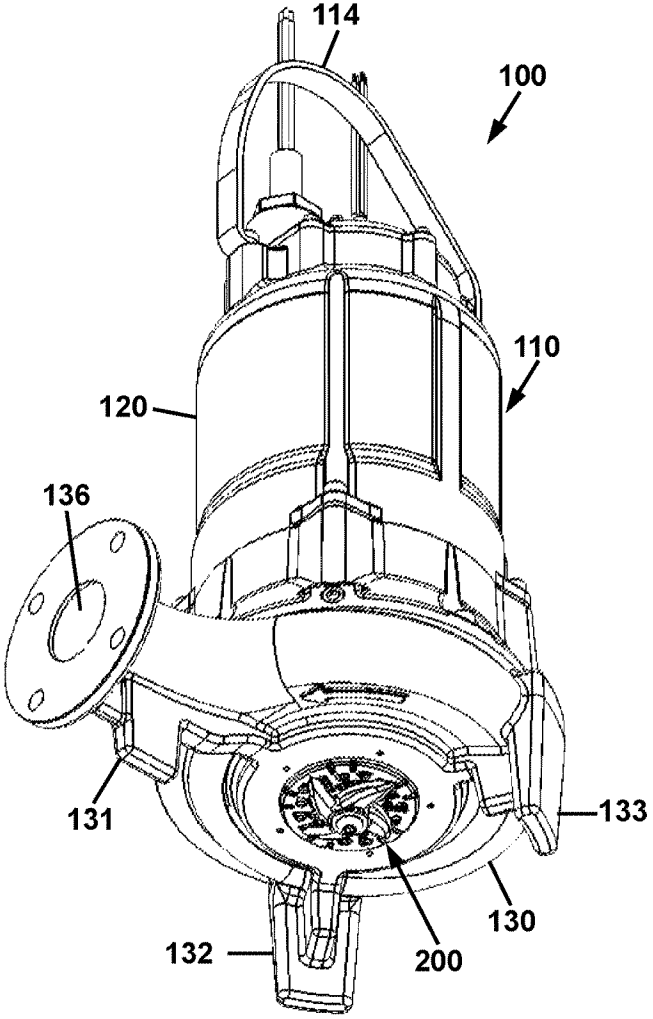
FIG. 5A is a lower perspective view of the grinder pump of FIG. 1.
Figure 6:
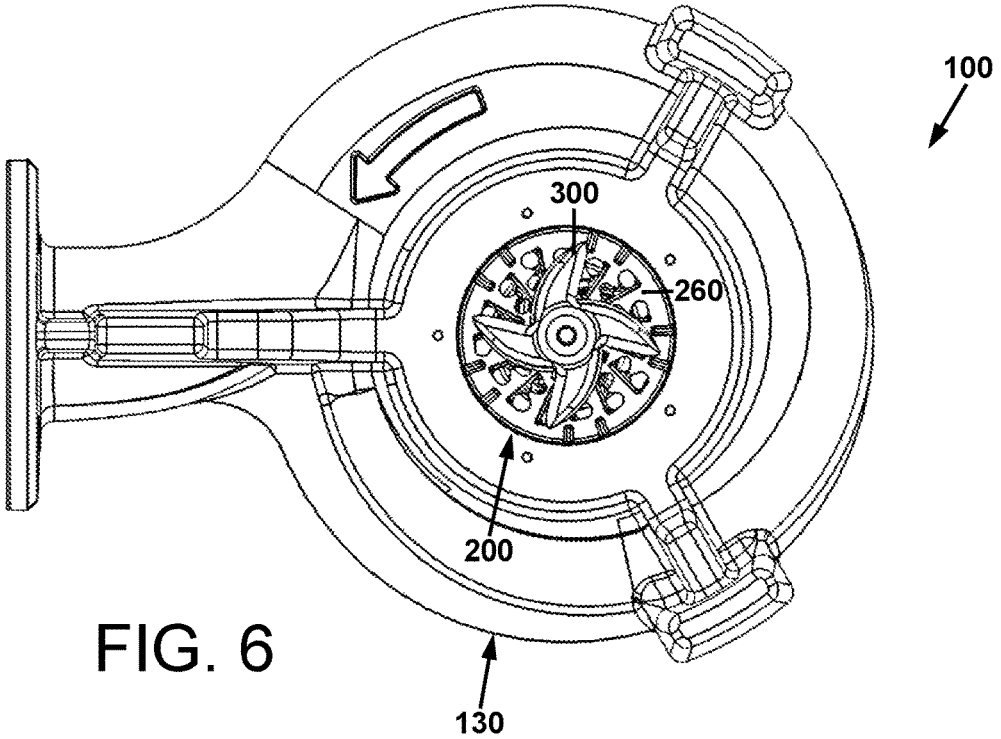
FIG. 6 is a bottom view of the pump depicted in FIG. 5A, and the cutting assembly thereof.

FIGS. 3 and 4 are detailed cross-sectional views of the volute portion of the pump 100 of FIGS. 1 and 2, including the pump volute housing 130 and the cutting assembly 200 thereof. During the operation of pump 100, the grinding and size reduction of solids (not shown) in a liquid stream occurs by the action of cutting assembly 200 in the flow regions indicated by arrows 199. Ground up suspended/homogenized solids and liquid are drawn into pump 100 by spinning impeller 140 and are discharged into pump volute 134 as indicated by arrows 198, and are subsequently discharged out of outlet 136 as indicated by arrow 197.

Impeller 140 is mounted on and operatively coupled to drive shaft 172 by suitable means such as e.g. a key engaged in key slots formed in impeller 140 and shaft 172. Impeller 140 and rotary cutter 300 are rotated in the direction indicated by arrow 196 (FIGS. 7A, 8 and 9) to perform the pumping of liquid through volute 134, and the grinding of solids in such liquid by cutting assembly 200 as will be described presently.

The general arrangement of the components of the cutting assembly 200 is best understood with reference to FIGS. 4-9. The cutting assembly 200 is comprised of a rotary cutter 300 and stationary cutter plate 250. Rotary cutter 300 is mounted on and operatively coupled to drive shaft 172 by suitable means such as a key (not shown), bolt 302, and washer 304. In operation, rotary cutter 300 spins with the rotation of shaft 172, and the leading cutting edges such as edge 312 of blade 310 are rotationally advanced along the outer cutter surface 260 of cutter plate 250 in a shearing action against the various cutting edges formed in cutter surface 260. Such cutting edges will be described in detail subsequently herein.

In the grinder pump 100 of the present disclosure, the cutter plate 250 is comprised of an inner wall 252 that includes a volute surface 251, which forms a portion of the volute 134 of the pump 100. The outer peripheral region of the inner wall 252 is formed as a flange 254, which is joined to a corresponding flange 135 of the volute housing by screws 137. An annular side wall 256 extends downwardly from the inner wall 252 through an opening 139 formed in the bottom wall 138 of the volute housing 130. The annular side wall 256 terminates at and is joined to the cutter wall 258 at the peripheral region thereof. The cutter wall 258, annular side wall 256, and an inner region 255 of the inner wall 252 form an annular cavity 259. The inner region 255 of the inner wall 252 is provided with a passageway therethrough, the perimeter of which is defined by a side wall 257 surrounding the drive shaft 172 and driven base 142 of the impeller 140, thereby forming an annular passageway that renders the annular cavity 259 in fluid communication with the pump volute 134. During operation of the grinder pump 100, liquid and suspended solids are drawn into the annular cavity 259, through the passageway defined by side wall 257, and onward into the pump volute 134 as indicated by arrows 199 and 198, and out though outlet 136 as indicated by arrow 197 (FIG. 3).

In the embodiment of the cutting assembly 200, and the pump 100 as depicted in FIGS. 1-9, the cutter surface 260 is provided as an outer surface of a cutter plate 256, which is joined to a flange 135 on the inner side of the volute wall 138. Alternative arrangements for providing a cutter surface 260 in combination with a rotary cutter 300 may be used. One alternative arrangement is disclosed in commonly owned U.S. Pat. No. 7,159,806 of Ritsema, the disclosure of which is incorporated herein by reference. In the cutting assembly of Ritsema, the cutter plate is formed as an integral part of a bottom cover, which forms the bottom wall of the pump volute. The cutting surface is provided on a bottom wall that is joined to an annular boss that extends downwardly from the main wall of the cover. Alternative structural arrangements are contemplated.

In the cutting assembly 200, the cutter surface 260 is ground flat such that in the operation of cutting assembly 200, surface 260 is perpendicular to drive shaft 172, and parallel to the plane of rotation of the cutting edges of the blades of rotary cutter 300. The running clearance between the cutting edges of the blades of rotary cutter 300 and cutter surface 260 may be selected during pump assembly or subsequently changed by the fitting of shims (not shown) at the base of the rotary cutter 300. The magnitude of the running clearance between the cutting edges of the blades of rotary cutter 300 and cutter surface 260, and the materials of construction of the rotary cutter 300 and cutter plate 250 may be as disclosed in U.S. Pat. No. 7,159,806 of Ritsema.

The cutting assembly 200 is provided with certain features that result in reduced wear and thus an increased service life and less frequent maintenance of the cutter assembly and grinder pump. These features are best understood with reference in particular to FIGS. 4, 5B, and 7A-7C.

Figure 7A:
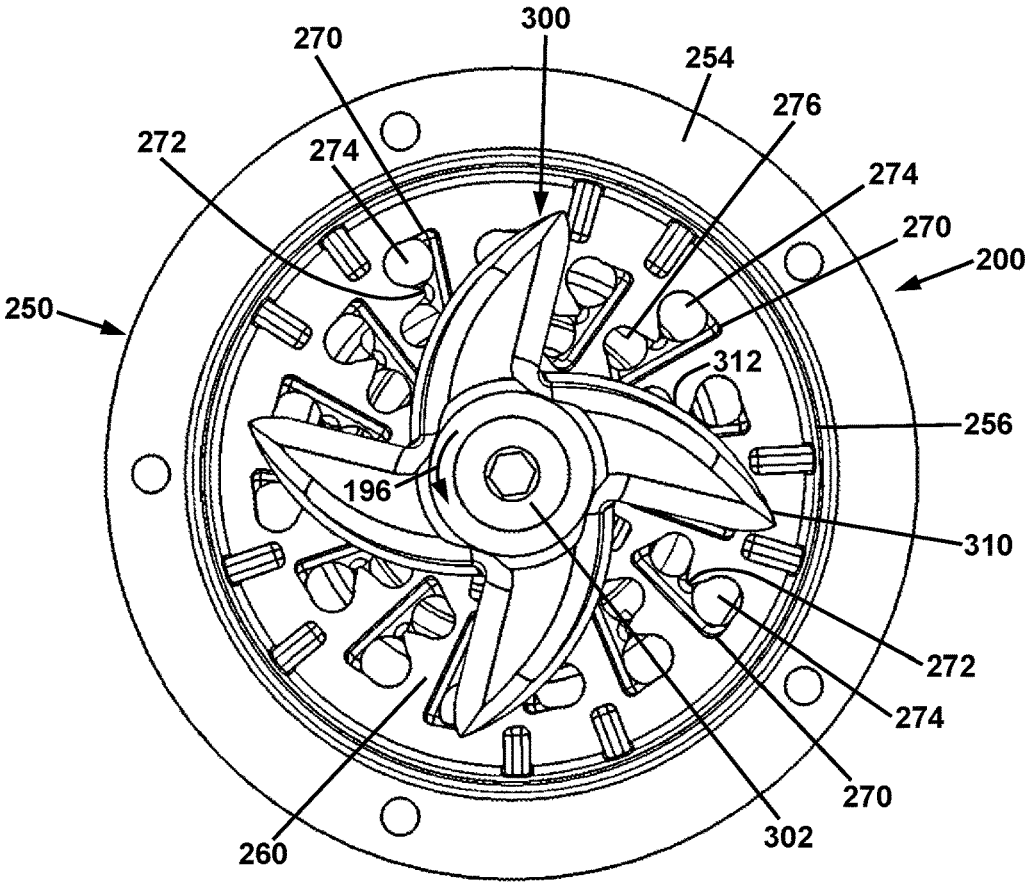
FIG. 7A is a bottom view of the cutting assembly of the pump as depicted in FIG. 6, but with the pump volute removed to show the cutting assembly in greater detail.
Figure 7B:
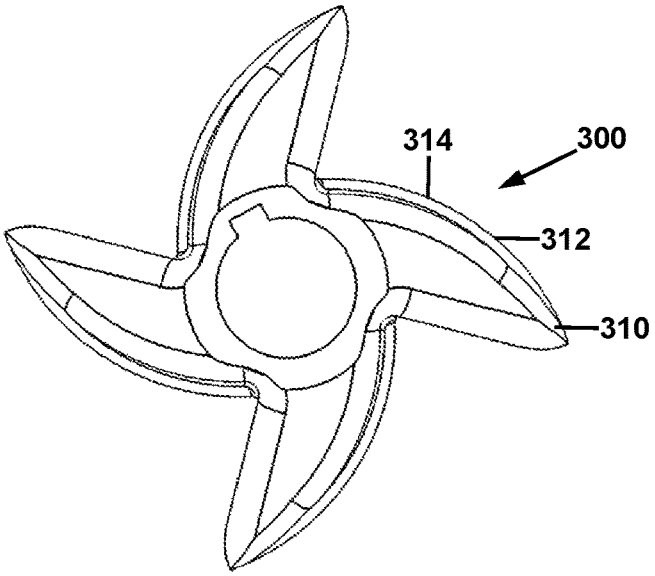
FIG. 7B is a bottom view of the rotary cutter of the cutting assembly of FIG. 7A.

The cutter plate 250 of the cutting assembly 200 is comprised of a cutter wall 258 including an inner discharge surface 262, and an outer cutter surface 260 that is perpendicular to the axis of rotation of the drive shaft 172. The cutter wall 258 has a central opening 263 defined by a side wall 253 surrounding an outer end portion 174 of the drive shaft 172, and a plurality of cutting ports 270. Referring in particular to FIG. 7A, Each of the cutting ports 270 comprises a plate cutting edge 272 and a first orifice 274 extending from the outer cutter surface 260 to the inner discharge surface 262.

The plurality of cutting ports 270 is distributed around the central opening 263 over a range of radial distances from the side wall 253 of the central opening 263. In operation of the cutting assembly 200, when the rotary cutter 300 is rotated in the first direction of rotation, the cutting blades 310 are rotationally advanced along the outer cutter surface 260 of the cutter wall 258 in a shearing action against the plate cutting edge of the radially innermost cutting port at a radially innermost cutting region of the cutting blades 310, against the plate cutting edges of radially intermediate cutting ports at a radially intermediate cutting region of the cutting blades, and against the plate cutting edge of the outermost cutting port at a radially outermost cutting region of the cutting blades. In that manner, the cutting action by the blades 310 of the rotary cutter 300 is distributed over nearly the entire lengths of the cutting edges 314 of the cutting blades 310, thereby distributing the wear on the cutting blades 310 evenly, and extending the life of the cutting assembly 200.

A variety of arrangements of the cutting ports 270 in the cutter wall 258 may be used to accomplish the desired result of evenly distributing the cutting action and any associated wear over the lengths of the cutting edges 314 of the cutting blades 310. One arrangement of cutting ports, as well as an exemplary rotary cutter 300 is depicted in detail in FIGS. 5B-7C. It is to be understood that the cutter plate 250 and rotary cutter 300 are to be considered as exemplary, and not limiting. Other cutting assembly arrangements are contemplated.

Turning to FIGS. 5B-7C, and in one embodiment, the plurality of cutting ports 270 may be provided in repeating groups 280 of cutting ports that are distributed around the central opening of the cutter wall 260. The groups 280 of cutting ports, or the individual cutting ports 270 may be distributed around the central opening of the cutter wall 258 at equal circumferential intervals. Within each group 280 of cutting ports, the ports may be distributed at equal radial intervals from an innermost radial location to an outermost radial location of the cutter wall 258. In certain preferred embodiments, each of the groups 280 of cutting ports may include from three to six cutting ports. In the embodiment depicted in FIGS. 5B-7C, five groups 280 of cutting ports each include three cutting ports 270.

Figure 7C:
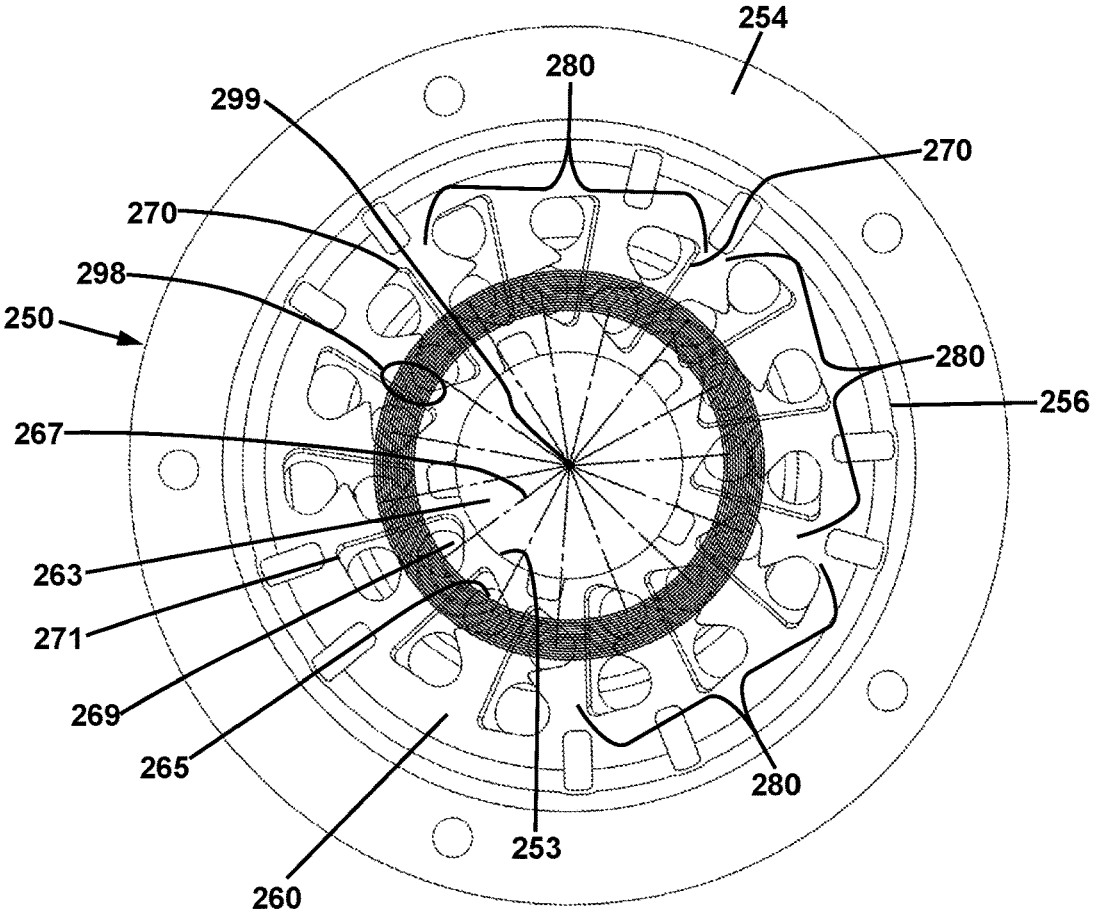
FIG. 7C is a bottom view of the cutter plate of the cutting assembly of FIG. 7A.

In another embodiment depicted in FIGS. 7A and 7C, the cutting ports 270 may be staggered, or distributed, over a range of radial locations. In such a configuration, each cutting port is located at a unique polar coordinate on the outer cutter surface 260 with respect to the axis of rotation of the drive shaft 172 and rotary cutter 300. In that manner, the cutting ports 270 are distributed from an innermost radial location to an outermost radial location of the cutter wall 258, such that for each of the cutting blades 310 of the rotary cutter 300, the plate cutting edges 272 of the cutting ports 270 define a series of cutting regions of the cutting blade 310 that form a continuous total cutting region of the cutting blade 310. Such an arrangement is effective in further distributing the wear on the cutting blades evenly. In the embodiment depicted in FIGS. 5B-7C, the arrangement of the cutting ports 270 is such that as the rotary cutter rotates, the cutting regions of the cutting blades move in sequence from an innermost cutting region to an outermost cutting region, because the cutting ports within any group 280 are located at an innermost radial location to an outermost radial location of the cutter wall 258, in the direction of rotation of the rotary cutter 300. However, this is not a required feature. Other arrangements of the cutting ports 270 may be used, provided that the cutting action by the blades 310 of the rotary cutter 300 is distributed over broad lengths of the cutting edges 314 of the cutting blades 310. In the exemplary embodiment depicted in FIG. 7C, the arrangement of the cutting ports 270 is such that each cutting port 270 is at a unique radial location on the outer cutter surface 260 with respect to the axis of rotation of the drive shaft. For example, the cutting port 271 is located on cutter surface 260 such that the center of orifice 269 of cutting port 271 is intersected by circle 265 having radius 267, originating at a central axis 299 of shaft 172. For the remaining ports 270, each port is located such that an orifice thereof is at a unique distance from central axis 299, as indicated by the remaining 14 indicating concentric circles 298 outside of circle 265. Each cutting port 270 is also located at a unique circumferential location, resulting in each cutting port 270 being located at a unique polar coordinate on the outer cutter surface 260 with respect to the axis of rotation of the drive shaft 172 and rotary cutter 300, as described above.

In certain embodiments, each of the cutting ports 270 may be comprised of a plurality of orifices. Such multi-orifice cutting ports may be provided in repeating groups of cutting ports distributed around the central opening of the cutter wall. In the embodiment of FIGS. 5B-7C, the cutting ports 270 are comprised of first orifices 274 and second orifices 276. The cutting ports may be as disclosed in the aforementioned U.S. Pat. No. 7,159,806 of Ritsema, in which the plate cutting edges 272 of the cutting ports 270 are V-slice cutting edges.

In the embodiment of FIGS. 5B-7C, the rotary cutter 300 is provided with four cutting blades 310 spaced at 90 degree intervals. Alternative cutter blade arrangements are contemplated, including three blades spaced at 120 degree intervals, and two blades spaced at 180 degree intervals.

It is therefore apparent that there has been provided, in accordance with the present disclosure, a cutting assembly, and a grinder pump comprised of such cutting assembly. The foregoing description of technology and the invention is merely exemplary in nature of the subject matter, manufacture, and use of the invention and is not intended to limit the scope, application, or uses of any specific invention claimed in this application or in such other applications as may be filed claiming priority to this application, or patents issuing therefrom. The following definitions and non-limiting guidelines must be considered in reviewing the description.

The headings in this disclosure (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

To the extent that other references may contain similar information in the Background herein, the statements do not constitute an admission that those references are prior art or have any relevance to the patentability of the technology disclosed herein. Any discussion in the Background is intended merely to provide a general summary of assertions.

The description and specific examples, while indicating embodiments of the technology disclosed herein, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

To the extent employed herein, the words "preferred" and "preferably" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

Unless otherwise specified, relational terms used in the present disclosure should be construed to include certain tolerances that those skilled in the art would recognize as providing equivalent functionality. By way of example, the term perpendicular is not necessarily limited to 90.00°, but also to any variation thereof that those skilled in the art would recognize as providing equivalent functionality for the purposes described for the relevant member or element. Terms such as "about" and "substantially" in the context of configuration relate generally to disposition, location, and/or configuration that is either exact or sufficiently close to the location, disposition, or configuration of the relevant element to preserve operability of the element within the invention while not materially modifying the invention. Similarly, unless specifically specified or clear from its context, numerical values should be construed to include certain tolerances that those skilled in the art would recognize as having negligible importance, as such do not materially change the operability of the invention.

As used herein, the words "comprise," "include," contain," and variants thereof are intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

I claim:

1. A cutting assembly for size reduction of solids in a liquid to be pumped, the cutting assembly comprising:

a) a drive shaft rotatable in a first direction around an axis of rotation;

b) a rotary cutter rotatably engaged with the drive shaft and comprised of at least a first cutting blade and a second cutting blade, each of the first and the second cutting blades including a curvilinear leading blade cutting edge defining a cutting plane and advanceable in the direction of rotation; and c) a cutter plate comprised of a cutter wall including an inner discharge surface, an outer cutter surface perpendicular to the axis of rotation of the drive shaft and coplanar with the cutting plane and contiguous with the curvilinear leading blade cutting edges of the first and second cutting blades, a central opening defined by a side wall surrounding an outer end portion of the drive shaft, and a plurality of cutting ports, each cutting port of the plurality of cutting ports comprising a plate cutting edge and a first orifice extending from the outer cutter surface to the inner discharge surface, the plurality of cutting ports distributed around the central opening over a range of radial distances from the side wall of the central opening, wherein a radially innermost cutting port of the plurality of cutter ports is located at a radially innermost location of the outer cutter surface of the cutter wall, radially intermediate cutting ports of the plurality of cutting ports are located at intermediate locations of the outer cutter surface of the cutter wall, and a radially outermost cutting port of the plurality of cutter ports is located at a radially outermost location of the outer cutter surface of the cutter wall;

wherein when the rotary cutter is rotated in the first direction of rotation, the cutting blades are rotationally advanced along the outer cutter surface of the cutter wall with the leading blade cutting edges in a shearing action along the cutting plane against the plate cutting edge of the radially innermost cutting port of the plurality of cutting ports at a radially innermost cutting region of the cutting blades, against the plate cutting edges of the radially intermediate cutting ports of the plurality of cutting ports at a radially intermediate cutting region of the cutting blades, and against the plate cutting edge of the outermost cutting port of the plurality of cutting ports at a radially outermost cutting region of the cutting blades.

2. The cutting assembly of claim 1, wherein the plurality of cutting ports are provided in repeating groups of cutting ports, the repeating groups distributed around the central opening of the cutter wall.

3. The cutting assembly of claim 2, wherein the groups of cutting ports are distributed around the central opening of the cutter wall at equal circumferential intervals.

4. The cutting assembly of claim 2, wherein each of the groups of cutting ports is comprised of cutting ports distributed at equal radial intervals from an innermost radial location to an outermost radial location of the cutter wall.

5. The cutting assembly of claim 2, wherein each of the groups of cutting ports includes from three to six cutting ports.

6. The cutting assembly of claim 1, wherein the plurality of cutting ports are distributed from an innermost radial location to an outermost radial location of the cutter wall such that for each of the cutting blades, the plate cutting edges of the plurality of cutting ports define a series of cutting regions of the cutting blade that form a total cutting region of the cutting blade.

7. The cutting assembly of claim 1, wherein the plurality of cutting ports are distributed over a range of radial locations, each cutting port of the plurality of cutting ports located at a unique radial location on the outer cutter surface with respect to the axis of rotation of the drive shaft.

8. The cutting assembly of claim 1, wherein each cutting port of the plurality of cutting ports is comprised of a plurality of orifices.

9. The cutting assembly of claim 8, wherein each cutting port of the plurality of cutting ports is comprised of a first orifice and a second orifice.

10. The cutting assembly of claim 9, wherein the plurality of cutting ports are provided in repeating groups of cutting ports, the repeating groups distributed around the central opening of the cutter wall.

11. The cutting assembly of claim 10, wherein the repeating groups of cutting ports include three cutting ports.

12. A grinder pump comprising a housing including a volute housing portion forming a pump volute enclosing a pump impeller, and a cutting assembly comprising:

a) a drive shaft rotatable in a first direction around an axis of rotation;

b) a rotary cutter rotatably engaged with the drive shaft and comprised of at least a first cutting blade and a second cutting blade, each of the first and the second cutting blades including a curvilinear leading blade cutting edge defining a cutting plane and advanceable in the direction of rotation; and c) a cutter plate comprised of a cutter wall including an inner discharge surface, an outer cutter surface perpendicular to the axis of rotation of the drive shaft and coplanar with the cutting plane and contiguous with the curvilinear leading blade cutting edges of the first and second cutting blades, a central opening defined by a side wall surrounding an outer end portion of the drive shaft, and a plurality of cutting ports, each cutting port of the plurality of cutting ports comprising a plate cutting edge and a first orifice extending from the outer cutter surface to the inner discharge surface, the plurality of cutting ports distributed around the central opening over a range of radial distances from the side wall of the central opening, wherein a radially innermost cutting port of the plurality of cutter ports is located at a radially innermost location of the outer cutter surface of the cutter wall, radially intermediate cutting ports of the plurality of cutting ports are located at intermediate locations of the outer cutter surface of the cutter wall, and a radially outermost cutting port of the plurality of cutter ports is located at a radially outermost location of the outer cutter surface of the cutter wall;

wherein when the rotary cutter is rotated in the first direction of rotation, the cutting blades are rotationally advanced along the outer cutter surface of the cutter wall with the leading blade cutting edges in a shearing action along the cutting plane against the plate cutting edge of the radially innermost cutting port of the plurality of cutting ports at a radially innermost cutting region of the cutting blades, against the plate cutting edges of the radially intermediate cutting ports of the plurality of cutting ports at a radially intermediate cutting region of the cutting blades, and against the plate cutting edge of the outermost cutting port of the plurality of cutting ports at a radially outermost cutting region of the cutting blades.

13. The pump of claim 12, wherein the cutter plate is further comprised of an inner wall comprising a volute surface forming a portion of the pump volute.

14. The pump of claim 13, wherein the cutter wall, side wall, and inner wall of the cutter plate form an annular cavity.

15. The pump of claim 14, wherein the annular cavity is in fluid communication with an exterior of the cutter wall, and in fluid communication with the pump volute.

16. A cutting assembly for size reduction of solids in a liquid to be pumped, the cutting assembly comprising:

a) a drive shaft rotatable in a first direction around an axis of rotation;

b) a rotary cutter rotatably engaged with the drive shaft and comprised of at least a first cutting blade and a second cutting blade, each of the first and the second cutting blades including a leading blade cutting edge advanceable in the direction of rotation; and c) a cutter plate comprised of a cutter wall including an inner discharge surface, an outer cutter surface perpendicular to the axis of rotation of the drive shaft, a central opening defined by a side wall surrounding an outer end portion of the drive shaft, and a plurality of cutting ports, each cutting port of the plurality of cutting ports comprising a plate cutting edge and a first orifice extending from the outer cutter surface to the inner discharge surface, the plurality of cutting ports arranged in repeating groups around the central opening over a range of radial distances from the side wall of the central opening, the repeating groups disposed immediately adjacent to each other;

wherein when the rotary cutter is rotated in the first direction of rotation, the cutting blades are rotationally advanced along the outer cutter surface of the cutter wall such that for each repeating group of cutting ports, each cutting edge of the first and second cutting blades sequentially applies a shearing action against the plate cutting edge of a radially innermost cutting port of that repeating group at a radially innermost cutting region of the cutting blades, then a shearing action against the plate cutting edges of radially intermediate cutting ports of that repeating group at a radially intermediate cutting region of the cutting blades, and then a shearing action against the plate cutting edge of an outermost cutting port of that repeating group at a radially outermost cutting region of the cutting blades.

17. A cutting assembly for size reduction of solids in a liquid to be pumped, the cutting assembly comprising:

a) a drive shaft rotatable in a first direction around an axis of rotation;

b) a rotary cutter rotatably engaged with the drive shaft and comprised of at least a first cutting blade and a second cutting blade, each of the first and the second cutting blades including a leading blade cutting edge advanceable in the direction of rotation; and c) a cutter plate comprised of a cutter wall including an inner discharge surface, an outer cutter surface perpendicular to the axis of rotation of the drive shaft, a central opening defined by a side wall surrounding an outer end portion of the drive shaft, and a plurality of cutting ports, each cutting port of the plurality of cutting ports comprising a plate cutting edge and a first orifice extending from the outer cutter surface to the inner discharge surface, the plurality of cutting ports distributed around the central opening over a range of radial distances from the side wall of the central opening, wherein a radially innermost cutting port of the plurality of cutter ports is located at a radially innermost location of the outer cutter surface of the cutter wall, radially intermediate cutting ports of the plurality of cutting ports are located at intermediate locations of the outer cutter surface of the cutter wall, and a radially outermost cutting port of the plurality of cutter ports is located at a radially outermost location of the outer cutter surface of the cutter wall;

wherein when the rotary cutter is rotated in the first direction of rotation, the cutting blades are rotationally advanced along the outer cutter surface of the cutter wall in a shearing action against the plate cutting edge of the radially innermost cutting port of the plurality of cutting ports at a radially innermost cutting region of the cutting blades, against the plate cutting edges of the radially intermediate cutting ports of the plurality of cutting ports at a radially intermediate cutting region of the cutting blades, and against the plate cutting edge of the outermost cutting port of the plurality of cutting ports at a radially outermost cutting region of the cutting blades; and wherein the plurality of cutting ports are distributed over a range of radial locations, each cutting port of the plurality of cutting ports located at a unique radial location on the outer cutter surface with respect to the axis of rotation of the drive shaft.

* * * * *